United States Patent [19]

Harvey

[11] 4,369,908

[45] Jan. 25, 1983

[54] STITCHERS

[75] Inventor: Raymond A. Harvey, Hertfordshire, England

[73] Assignee: Xerox Corporation, Stamford, Conn.

[21] Appl. No.: 106,185

[22] Filed: Dec. 21, 1979

[30] Foreign Application Priority Data

Jan. 30, 1979 [GB] United Kingdom ..... 7903129

[51] Int. Cl.[3] ..... B27F 7/21; B27F 7/23

[52] U.S. Cl. ..... 227/90; 227/87; 227/89

[58] Field of Search ..... 227/87, 88, 89, 90, 227/91, 98

[56] References Cited

U.S. PATENT DOCUMENTS

| | | | |
|---|---|---|---|
| 2,190,684 | 2/1940 | Sims et al. | 227/91 X |
| 2,324,480 | 7/1943 | Carlson | 227/89 X |
| 3,008,144 | 11/1961 | Fryklund | 227/89 X |
| 3,263,467 | 8/1966 | Gagnon | 227/89 X |
| 3,504,838 | 4/1970 | Cairatti | 227/89 |
| 3,593,404 | 7/1971 | Ragard | 227/91 X |

FOREIGN PATENT DOCUMENTS

| | | |
|---|---|---|
| 278952 | 10/1927 | United Kingdom . |
| 525649 | 9/1940 | United Kingdom . |
| 617031 | 1/1949 | United Kingdom . |
| 640073 | 7/1950 | United Kingdom . |
| 692106 | 5/1953 | United Kingdom . |
| 693007 | 6/1953 | United Kingdom . |
| 1086501 | 10/1967 | United Kingdom . |
| 1244061 | 8/1971 | United Kingdom . |

*Primary Examiner*—Paul A. Bell

*Attorney, Agent, or Firm*—Bernard A. Chiama

[57] ABSTRACT

A wire stitcher in which a piece of wire is cut from a supply of wire W fed to a stitcher head and formed and driven through a set of sheets to bind the sheets together. The wire is guided into position relative to the driver and former by a guide mechanism arranged in the path of the former and which is resiliently mounted so as to be displaced by the former during forming.

5 Claims, 10 Drawing Figures

105
106
109
125
121
123
103
120
122
124
138
139
133
55
202
206
210
205
204
217
209
207
201
208
203
101
104
110
W
108
107
104a

STITCHERS

This invention relates to wire stitchers and particularly to such apparatus for binding sets or signatures of sheets or documents. Stitchers take various well-known forms. There are those (called staplers) which use preformed staples, those using pre-cut lengths of wire which are formed in the machine and those in which the staples are formed from a continuous wire wound on a spool from which pieces are cut and formed in the machine. In each case the legs of the formed staple or stitch are driven through the set until the crown of the staple lies against one face of the set and the ends of the staple legs are bent over against the opposite face of the set to form clinches. The present invention is concerned with stitchers of the kind in which the staples are formed from wire stock.

More particularly, the invention is concerned with guiding the wire into position for cutting, forming and driving and to this end, the invention provides a wire stitcher in which a piece of wire is cut from a supply of wire and formed and driven through a set of sheets to bind the sheets together, wherein the wire is guided into position relative to the driver and former by a guide arranged in the path of the former and which is resiliently mounted so as to be displaced by the former during forming.

In one preferred form of the invention for a stitcher in which the wire is positioned between the driver and an anvil about which the wire is formed and against which it is gripped during cutting and forming, two lateral guide members are provided between the anvil and driver and cooperate with each other and the anvil and driver to form a closed tubular path for the wire.

In another embodiment, the guide member is arranged on the side of the anvil opposite the cutter and presents a cone shaped target to the advancing wire.

The stitcher may be incorporated with a sheet stitcher/compiler as part of a finisher for a photocopier and such a finisher may form part of the photocopier or take the form of a separate unit.

In order that the invention may be more readily understood, reference will now be made to the accompanying drawings in which:

FIG. 1 is a schematic side elevation of an exemplary form of photocopier incorporating a finisher incorporating a stitcher according to this invention, FIG. 2 is a schematic view illustrating the principles of one embodiment of stitcher of this invention suitable for use in the finisher of FIG. 1, FIG. 3 is a scrap view of the stitcher shown in FIG. 1 illustrating schematically the relationship of various parts of the stitcher, FIG. 4 is a perspective view of the clincher showing the drive therefor, FIG. 5 is a perspective view of the mechanism for feeding wire to the stitcher head, FIG. 6 is a scrap perspective view of the stitcher head illustrating the mechanism for guiding the wire into position beneath the driver.

Figure 1:
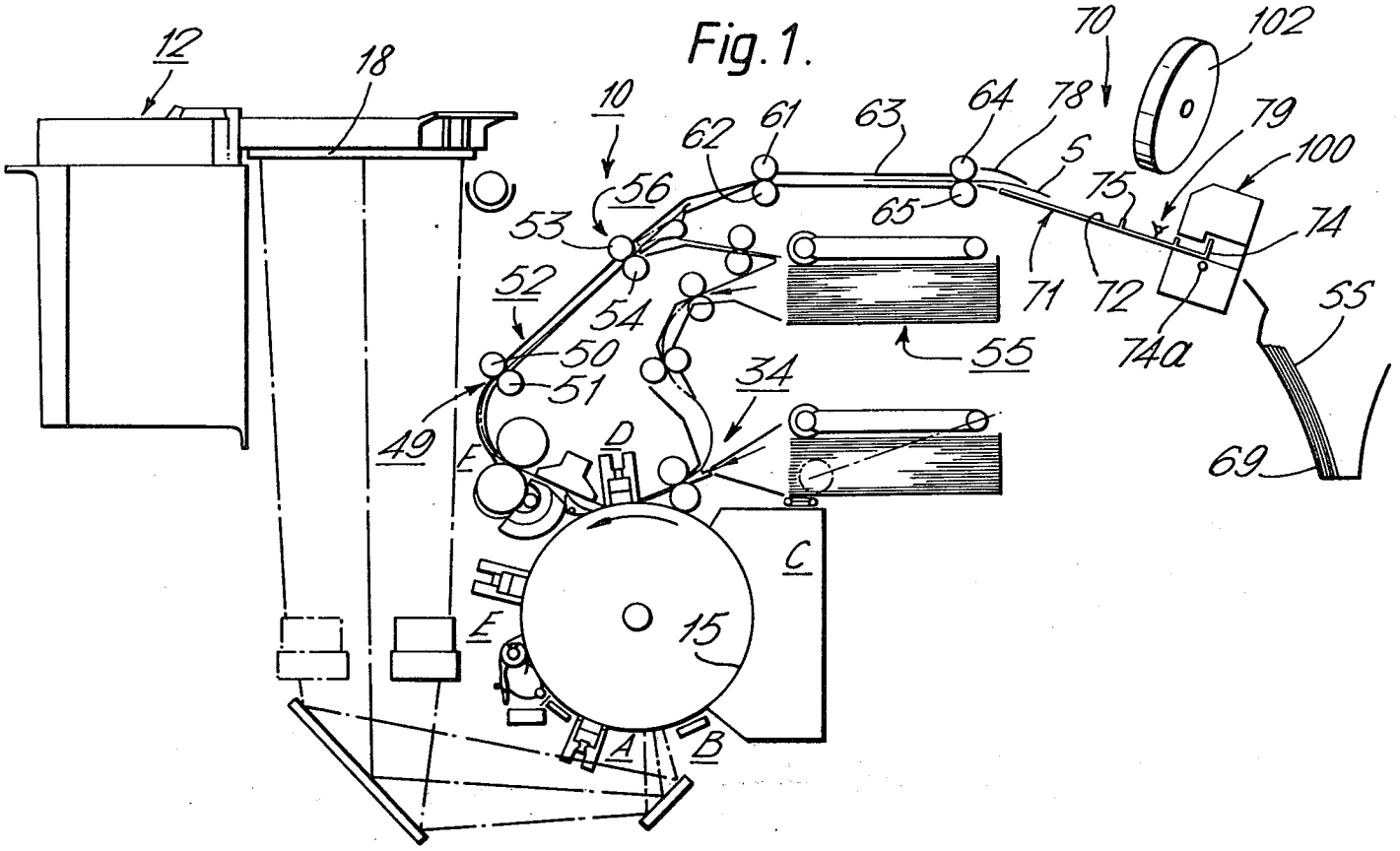

Referring to FIG. 1 there is shown an automatic xerographic reproducing machine 10 having a finisher 70 incorporating a stitcher 100 according to this invention. The copying machine 10 is capable of producing either simplex or duplex copies in sets from a wide variety of originals which may be advanced in recirculating fashion by recirculating document apparatus 12 described in U.S. Pat. No. 3,556,512. Although the present invention is particularly well suited for use in automatic xerography, the apparatus generally designated 100 is equally well adapted for use with any number of devices in which cut sheets of material are delivered or compiled in a set or stack.

The processor 10 includes a photosensitive drum 15 which is rotated in the direction indicated so as to pass sequentially through a series of xerographic processing stations: a charging station A, an imaging station B, a developer station C, a transfer station D and a cleaning station E.

A document to be reproduced is transported by document handling apparatus 12 from the bottom of a stack to a platen 18 and scanned by means of a moving optical scanning system to produce a flowing light image on the drum at B. Cut sheets of paper are moved into the transfer station D from sheet registering apparatus 34 in synchronous relation with the image on the drum surface. The copy sheet is stripped from the drum surface and directed to a fusing station F. Upon leaving the fuser, the fixed copy sheet is passed through a curvilinear sheet guide system, generally referred to as 49, incorporating advancing rolls 50 and 51. The advancing rolls forward the sheet through a linear sheet guide system 52 and to a second pair of advancing rollers 53 and 54. At this point, depending on whether simplex or duplex copies are desired, the simplex copy sheet is either forwarded directly to the finisher 70 via pinch rolls 61, 62 or into upper supply tray 55 by means of a movable sheet guide 56 before the finishing apparatus for the duplexed copy. Movable sheet guide 56, and associated advancing rolls are prepositioned by appropriate machine logic system to direct the individual sheets into the desired path.

The finisher 70 comprises a tray 71 having a base or support surface 72 inclined downwardly in the direction of sheet travel towards a registration corner defined by registration fences 74, 75 extending along the lower edge and one side of the tray. Above the upper end of the support surface is arranged a pair of coacting sheet feed rolls 64, 65 arranged to receive sheets fed along path 63 by pinch rolls 61, 62. From the feed rolls 64, 65, a sheet is directed by guide throat 78 towards the tray 71. A corner registration device 79 such as a paddle wheel like that described in U.S. Pat. No. 3,669,447 is arranged over the surface 72 to urge the sheets S into the registration corner to position them for receiving a stitch from the apparatus 100. The registration fence 74 is rotatable about an axis 74*a* so that it may be retracted for ejection of bound sets SS into a collection tray 69. Any suitable ejection mechanism, such as drive rollers, may be employed.

Figures 2, 3:
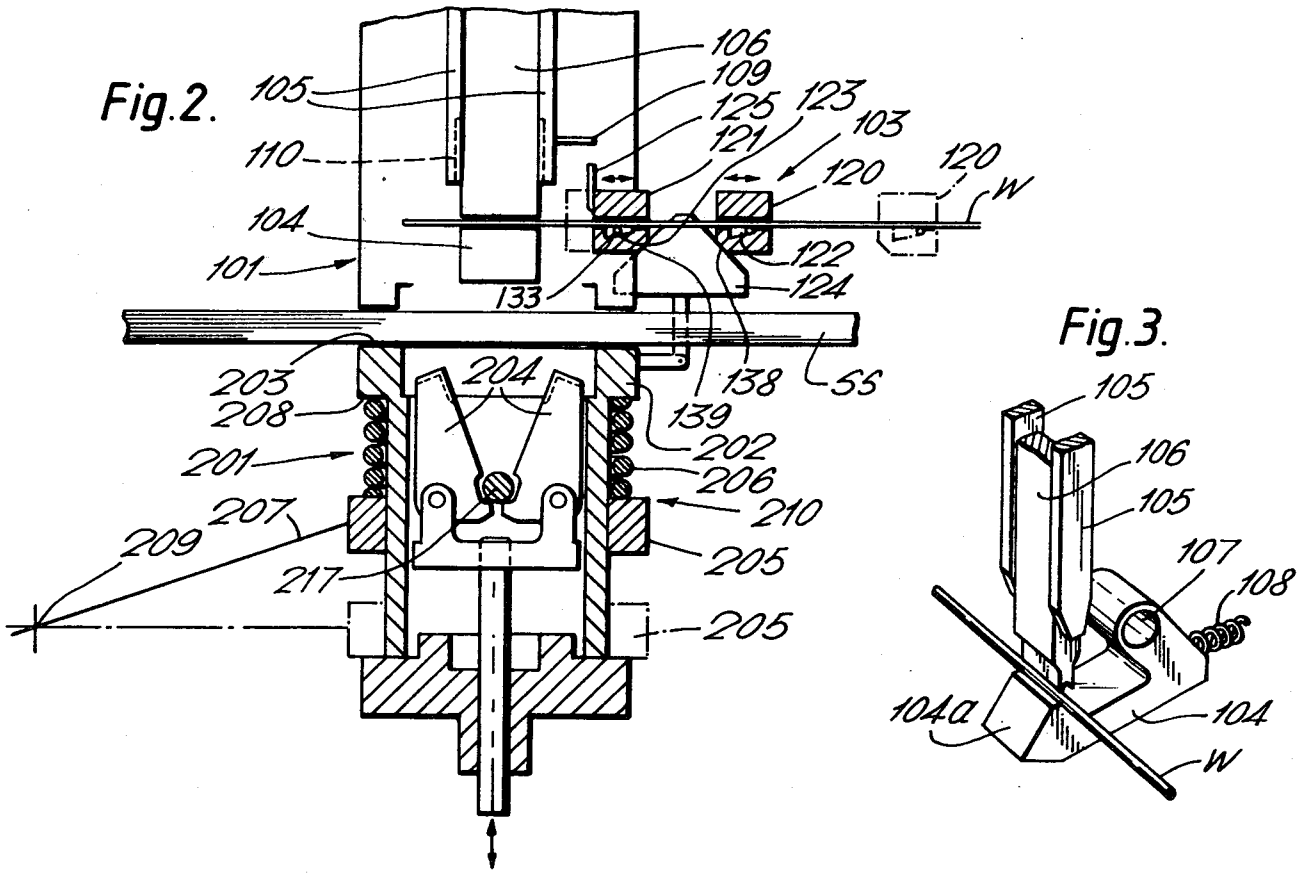

Referring now to FIGS. 2 and 3 of the drawings, the stitcher 100 comprises a stitcher head 101, a reel 102 (FIG. 1) from which wire W is supplied via a dancer (not shown) to the head 101 and an active clincher 201. The head 101 includes a wire advancing and cutting mechanism generally indicated at 103 for presenting lengths of cut wire to the stitcher head, an anvil 104 for supporting the wire, a former 105 including two elements at opposite sides respectively of the driver for forming the wire into a generally U-shape about the anvil and a driver 106 for driving the formed staple through the set SS. The clincher 201 comprises a clincher housing 202 having a clamping surface 203 by which a set SS may be clamped against the underside of the stitcher head 101 and containing clinch ears 204 arranged to receive and act upon staple legs driven through the set and into the housing through a slot in the surface 203.

Figure 4:
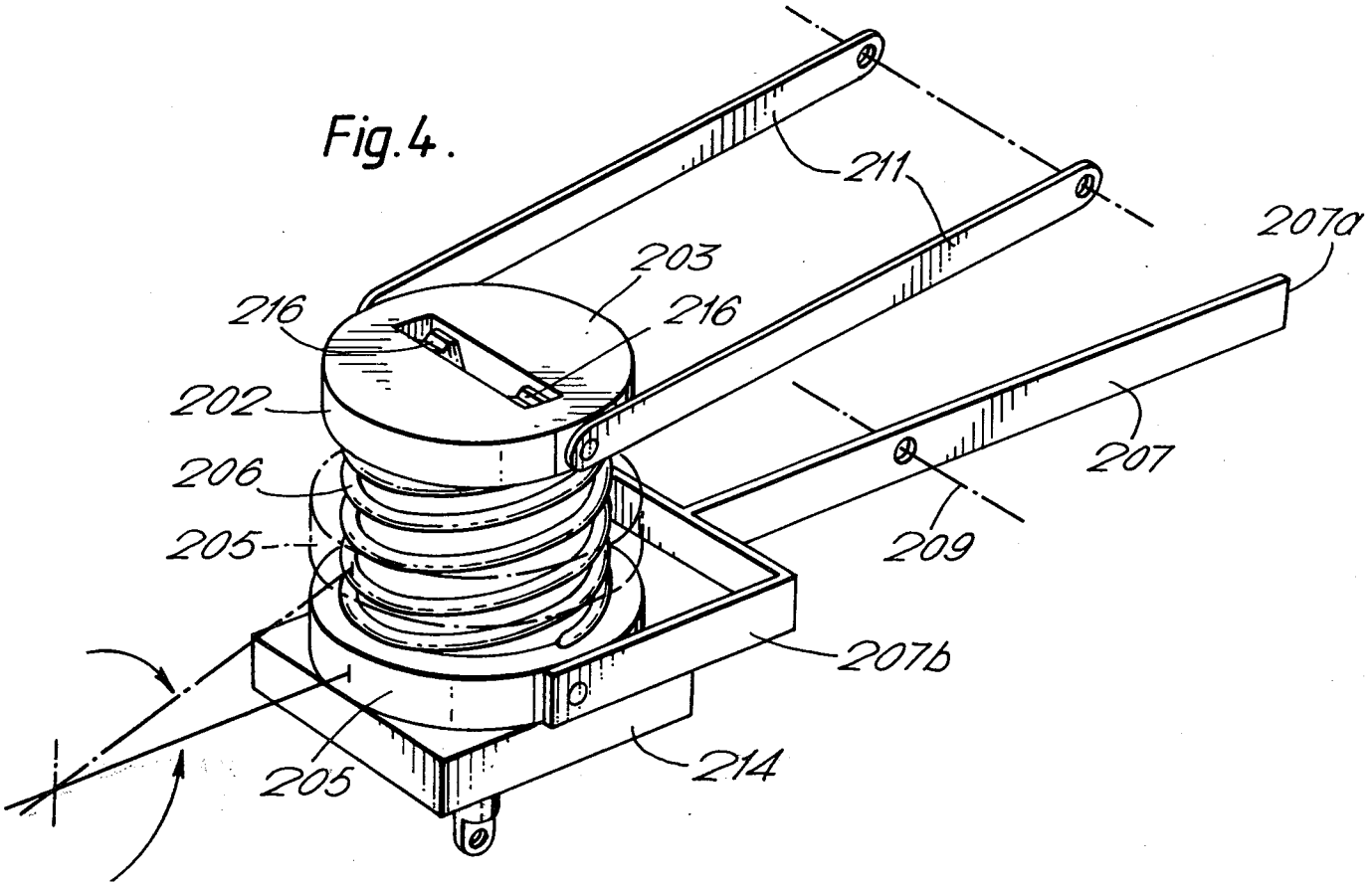

In FIG. 2, the clincher 201 is shown in its operative position with a set SS positioned against the head 101 which is fixed in position above the compiler tray. It will be understood, however, that during compilation of the set, the clincher is lowered so that the clamping surface 203 is below the support surface 72 of tray 71. During a stitching operation the clincher 201 is raised to lift the set SS against the underside of the head 101 and clamp it in position. Variations in set thickness are accommodated by the drive mechanism 210 by which the clincher housing is raised to lift the set against the underside of the stitcher head and clamp it into position to receive a stitch. This mechanism comprises a force applying ring 205 which lifts the housing via a compression spring 206, being moved through a fixed distance by a lever 207 (see FIG. 4). Th spring 206 is positioned between the force applying ring 205 and a shoulder 208 and the lever 207 which is arranged to pivot about axis 209 is actuated by a cam (not shown) which acts on its free end 207*a*. As shown in FIG. 4 the other end of the lever is bifurcated to form a yoke 207*b* which is pivotally connected to the force ring 205. The clincher housing 202 is supported and guided by a pair of arms 211 pivotally connected between the housing and the frame of the stitcher. The mechanism 210 in addition to accommodating varying set thicknesses, varies the clamping pressure applied to the set as a function of set thickness. Thus, the thinner the set the less the compression of spring 206 and the less the clamping force applied. The clincher ears 204 are positioned in fixed relation to the housing 202 so that they are always presented to the set in the same relation regardless of the set thickness.

Referring to FIG. 2, the wire advancing and cutting mechanism 103 comprises movable wire advancing and cutter blocks 120, 121 and an inhibitor member 124 positioned by the clincher 201 in dependence on the thickness of the set of sheets SS. The blocks 120, 121 includes wire diodes 122, 123 which grip the wire only against movement relative to the respective block in the direction opposite the wire advancing direction. Thus, the diodes grip the wire when the blocks are moved to the left but allow each block to be moved to the right along the wire while the other block holds the wire. At the start of a wire feed cycle, the blocks 120 and 121 are positioned as shown in dotted lines in FIG. 1. To feed the wire W, the advancing block 120 is moved to the left, its diode 122 gripping the wire, to advance the wire past the rest or start-of-cycle position of the cutter 125 by a distance made up of a constant (crown length plus twice clinch length) plus the set thickness and the cutter block is retracted from its rest position by a distance equal to the set thickness. These movements and thus the length of wire C presented to the stitcher head 101 for severing by the cutter 125 is determined by the inhibitor member 124 which limits the movement of the blocks 120, 121, according to the thickness of the set. The blocks 120, 121 are shown in full lines in their final positions at the end of a wire advancing movement. As the mechanism recycles to its start position (which takes place at the end of the complete stitching cycle) the cutter block 121 returns to its rest position pulling the wire with it—so that the wire end is always in the same position at the start of a feed cycle—and the advancing block 120 traverses back along the wire to its rest position.

Figure 5:
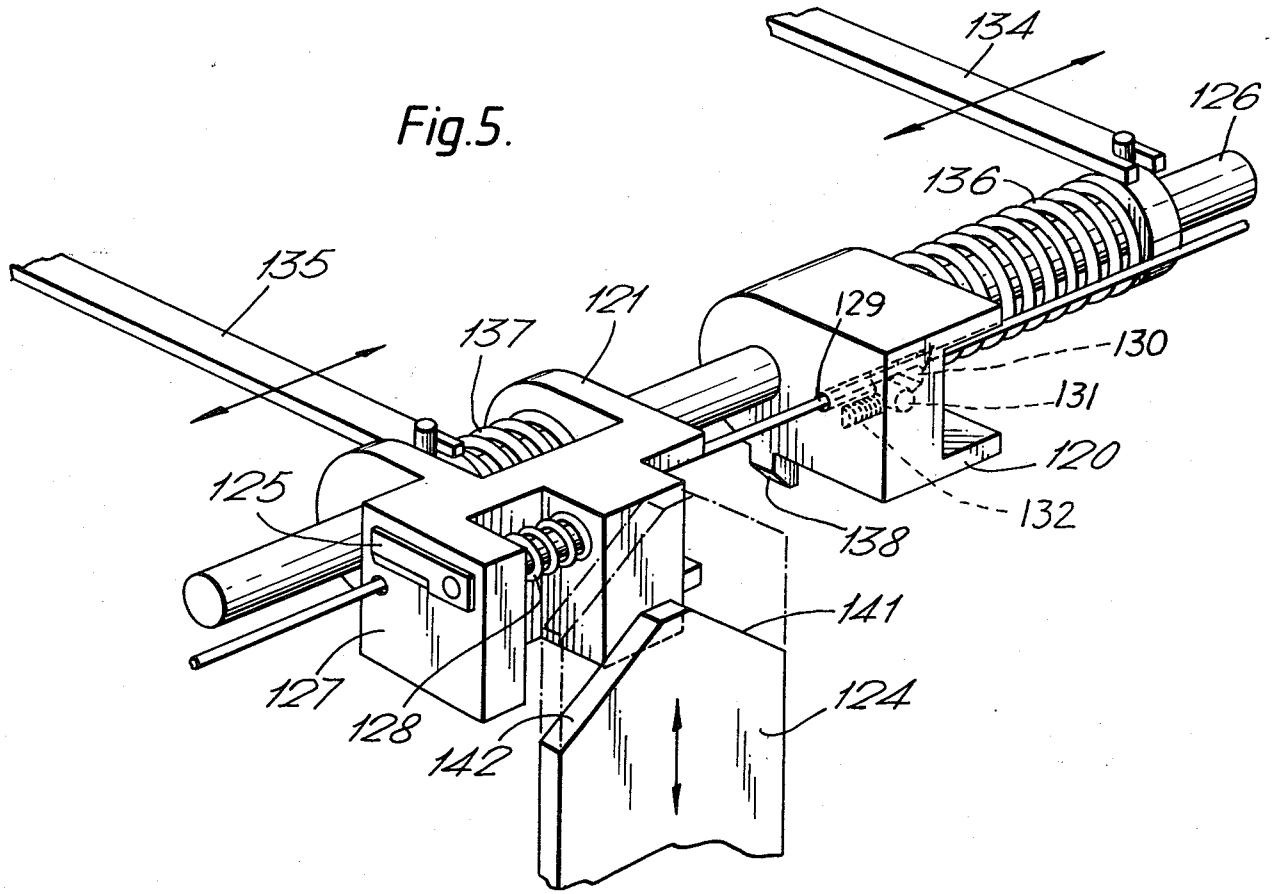
Figure 6:
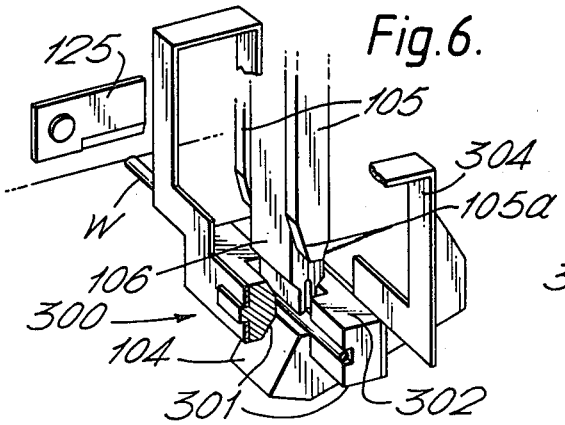

The wire advancing and cutting mechanism 103 is more fully illustrated in FIGS. 5 and 6 from which it will be seen that the advancing block 120 and the cutter block 121 are both mounted for horizontal sliding movement on a guide rail 126. In FIGS. 2, 4 and 5, the wire advancing direction is from right to left and the cutter 125 is pivotally mounted on the left-hand end 127 of the cutter block which forms a shear face. The cutter is actuated by a projection 109 on the former 105 as described below and is returned to its inactive position following an operating cycle by a tension spring 128. The blocks 120, 121 have bores 129 through which the wire W is threaded and which incorporate the wire diodes 122, 123. As best shown in FIGS. 2 and 5 the diodes comprise a cavity 130 along the bore 129 which contains a roller bearing 131 lightly loaded by a spring 132. The face 133 of the cavity opposite the bore is inclined so that the cavity tapers in the wire advancing direction and the spring 132 urges the roller bearing into engagement with the wire. The blocks 120, 121 are respectively driven by levers 134, 135 through override springs 136, 137. The levers are driven by cams (not shown) through a fixed travel and the springs 136, 137 accommodate the variations in the travel of the blocks 120, 121 imposed by the inhibitor member 124. The latter is mounted for vertical sliding movement with the clincher housing 202 as schematically illustrated in FIG. 2. The inhibitor member 124 has two opposed 45° faces 141, 142 which are engaged by 45° faces 138, 139 respectively on the advancing block 20 and the cutter block 121. Using 45° faces, the relationship between the position of the clincher housing and the inhibitor 124 is linear and 1:1.

During the feeding of the wire into the stitcher head it is, in accordance with the invention, guided into position between the driver 106 and the anvil 104 by means of a guide mechanism 300 which is more fully described with reference to FIGS. 6 to 10.

The length of wire presented to the stitcher head 101 by the mechanism 103 is cut, formed and driven in the following manner. While the anvil 104, which is pivotally mounted at 107 and biassed to its start-of-cycle position by a spring 108 as shown in FIG. 3, is held against movement the driver 106 is moved downwardly against the wire to clamp it in position on the anvil. The former elements 105 then start moving downwardly. Initial movement of the former operates the cutter 125 through actuator 109 to sever the required wire length and further movement thereof shapes the wire about the anvil 104 into a generally U-shape. In order to accommodate the wire during this operation, the formers have guide grooves 110 along their inner faces. At the end of the forming operation the lower ends of the former elements 105 are slightly below the underside of the anvil 104. The anvil is now driven downwardly, pivoting about its axis 107, to drive the formed staple. As seen in FIG. 3, the anvil includes a sloping surface 104*a*. During the driving operation in which the driver 104 and former elements 105 move together, the anvil surface 104a forms a support for the crown of the staple. Similarly the former elements, movement of which is arrested by contact thereof with the set, serve to support the legs of the staple in the grooves 110 during the driving movement.

It will be realised from the foregoing that the anvil must be held against movement during the cutting and forming stage but be pushed out of the way during the driving stage. This may be achieved by using a spring 108 which is strong enough to hold the anvil stationary during cutting and forming. However, this requires that the force available to drive the driver must be sufficient also to overcome the resistance of the spring. It is preferred therefore that as described with reference to our copending Application No. 50326/78 U.S. Ser. No. 106,324, filed on even date herewith, the anvil be held locked in position during the cutting and forming stage and released by the former 105 at the end of its travel whereby only a relatively light spring 108 is required which is sufficient to return the anvil to its start-of-cycle position and to ensure that the anvil supports the staple crown during the driving stage.

Wire feed mechanisms suitable for use with this invention are described more fully in our copending Applications Nos. 50328/78 U.S. Ser. No. 106,423, filed on even date herewith and 50325/78 U.S. Ser. No. 106,198.

As described above, the stitcher has a two stage driver action in which following wire feed a first stage motion operates to grip the wire W against the anvil 104 during cutting and forming and a second stage motion acts following forming to effect driving of the formed staple. A mechanism suitable for this operation based on pivoted motions which first holds the wire against the anvil and then provides the driving motion all from one continuous input lever travel is described in our copending Application No. 50324/78 U.S. Ser. No. 106,421, filed on even date herewith.

The ends of the staple legs are turned over and wiped flat against the underside of the set by the clincher ears 204. The clincher 201 is operated as described more fully in our copending Application No. 50327/78 U.S. Ser. No. 106,197, filed on even date herewith so that the staple legs having passed through the set move through air and meet no further resistance during driver travel. This is achieved by arranging the clincher ears out of the paths of the staple legs during driver travel so that leg wander is accommodated wholly within the clinch ears by profiling the ears with a groove wide enough to accommodate the maximum leg wander anticipated. The drive to the clincher ears may be by a spring which is loaded during return motion of the clincher housing at the completion of a stitching operation as more fully described in our copending Application No. 50323/78 U.S. Ser. No. 106,193, filed on even date herewith, the clinch ears being held latched in the position shown in FIG. 2 prior to the operation thereof, or by a cam drive.

Figure 7:
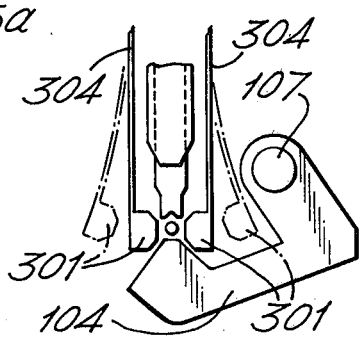
FIG. 7 is an end elevation of the mechanism shown in FIG. 6.
Figure 8:
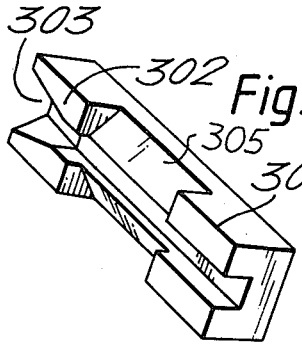
FIG. 8 shows one of the guide members of the mechanism of FIG. 6.

One guide mechanism 300 by which the wire is guided and accurately located between the driver 106 and the anvil 104 during the wire advancing step will now be described with reference to FIGS. 6 to 8. As shown in FIG. 6, the mechanism 300 comprises a pair of lateral guides 301 arranged between the anvil and the driver. The guides 301 include ears 302 at each end which cooperate with the adjacent ears of the opposing guide to form a tubular closed path presenting a cone shaped target 303 (one half of which is visible in FIG. 8) to wire coming from the cutter block 121. Intermediate the ears 302 the tubular path is formed by the guides in conjunction with the anvil 104 and the driver 106 as shown in FIG. 7. The guides 301 interfere with the forming operation and for this reason are spring-mounted to permit them to be swung away from the formers as they descend. A spring mounting 304 is shown. For effecting the swinging away of the guides, they are provided intermediate the ears with bevelled surfaces 305 which are engaged by tapered ends 105a of the former elements 105 to swing them into the position shown in dotted lines in FIG. 7.

Figure 10:
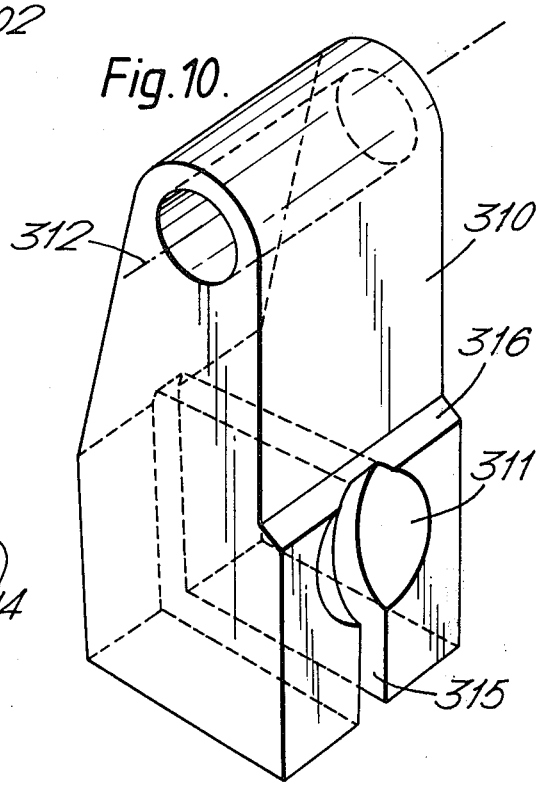
FIG. 10 is a perspective view of the guide or catcher of the mechanism of FIG. 9.
Figure 9:
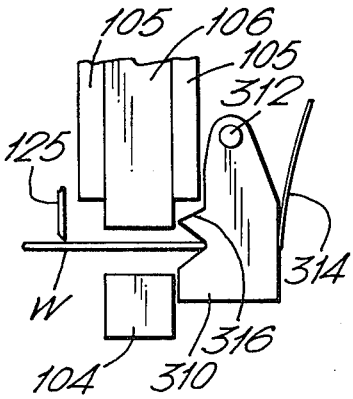
FIG. 9 shows schematically a second embodiment of mechanism for guiding the wire into position beneath the driver.

Another guide mechanism 300 is shown in FIGS. 9 and 10.

Here the wire is aligned by a cone shaped target 311 formed in a catcher block 310 arranged on the side of the anvil 104 remote from the cutter 125. The catcher block is pivoted at 312 and held in position immediately adjacent the driver and anvil with its target face 313 engaging the anvil 104 by a spring 314. The block 310 is slotted at 315 to accommodate the wire end and is arranged so that, as seen in FIG. 9, the shortest wire length fed will just penetrate into the slot 315 to ensure correct lateral aignment. For convenience of manufacture the slot 315 extends from the bottom face of the catcher block 310 but it will be realised that vertical misalignment occurring in this region is corrected when the driver 106 clamps the wire W against the anvil 104 prior to cutting. Since the catcher 310 is immediately adjacent the driver, it is arranged in the path of the former element 105 and as the former descends it engages surface 316 of the catcher block 310 and pivots the block out of the way against spring 314.

Whilst specific embodiments of the invention have been described above it will be understood that various modifications may be made to the specific details referred to herein without departing from the scope of the claims as defined in the appended claims. Thus, the principles of this invention although described in relation to a flat bed stitcher may equally be applied to a saddle stitcher.

Further, while in the apparatus described above the stitcher is fixed in position, it may be movable for varying the position of the stitch or for inserting more than one stitch in a set. Also, two or more stitchers according to the invention, which may themselves be movable, may be operated in tandem, in which case various of the drive elements may be common to avoid duplication.

It will also be understood that while in the embodiments described, the stitcher head is fixed, the clincher could be fixed and the clamping means be formed by the sheet receiving surface of the head itself.

It will further be understood that although the embodiments of stitcher described and illustrated show the stitcher head above the clincher, the stitcher may be arranged in any suitable orientation and specifically the clincher may be arranged over the stitcher head.

For clarity, it is to be noted that the term staple is used herein to mean either a wire-fastener which is pre-formed outside the stitching machine or one which is formed within the machine.

The ends of the staple or stitch legs may be turned over by an active clincher including ears which are wiped against the leg ends as described above or by a passive clincher having fixed guide surfaces. The advantage of an active clincher is that the legs are wiped flat against the set.

What is claimed is:

1. A wire stitcher apparatus having an anvil, a driver and a staple former wherein a piece of wire is cut from a supply of wire and driven through a set of sheets to bind the sheets together, the improvement including guide means for the wire for guiding the same into position relative to the driver and former, said guide means including at least one guide member arranged in the path of the former and being resiliently mounted so as to be displaced by the former during forming, means for resiliently biasing the anvil with the wire positioned thereon during the cutting of the wire and the forming of a staple and to displace the anvil during the driving motion of the driver through a set of sheets, and means formed on the driver and the anvil for positively gripping the wire during cutting and forming and wherein said guide means includes two guide members movable toward and away form each other.

2. The stitcher apparatus according to claim 1 wherein said guide members are arranged to form therewith a tubular guide path for the wire.

3. The stitcher apparatus according to claim 2 wherein said guide members include ears at each end which cooperate with adjacent ears on the opposing guide member to extend said tubular guide path beyond each side of the anvil and driver.

4. A wire stitcher apparatus having an anvil, a driver and a staple former wherein a piece of wire is cut from a supply of wire and driven through a set of sheets to bind the sheets together, the improvement including guide means for the wire for guiding the same into position relative to the driver and former, said guide means including at least one guide member arranged in the path of the former and being resiliently mounted so as to be displaced by the former during forming, means for resiliently biasing the anvil with the wire positioned thereon during the cutting of the wire and the forming of a staple and to displace the anvil during the driving motion of the driver through a set of sheets, and means formed on the driver and the anvil for positively gripping the wire during cutting and forming and wherein said guide member is arranged on the side of the anvil opposite the cutter and presents a cone shaped target to a wire being advanced into position.

5. The stitcher apparatus according to claim 4 wherein said guide member is pivotally mounted about an axis transverse to the wire advancing direction and is slotted in the forming and driving plane.

* * * * *